United States Patent [19]

Brede et al.

[11] Patent Number: 4,495,866

[45] Date of Patent: Jan. 29, 1985

[54] FLASH GUIDE TUBE ARRANGEMENT FOR PROPELLANT CHARGE IGNITERS

[75] Inventors: Uwe Brede, Furth; Günter Hübsch, Kalchreuth; Rudolf Stahlmann, Furth, all of Fed. Rep. of Germany

[73] Assignee: Dynamit Nobel Aktiengesellschaft, Troisdorf, Fed. Rep. of Germany

[21] Appl. No.: 427,185

[22] Filed: Sep. 29, 1982

[30] Foreign Application Priority Data

Dec. 28, 1981 [DE] Fed. Rep. of Germany ..... 3151673

[51] Int. Cl.[3] ..... F42C 19/08

[52] U.S. Cl. ..... 102/202; 102/205

[58] Field of Search ..... 102/202, 204, 205, 469, 102/470

[56] References Cited

U.S. PATENT DOCUMENTS

| | | | |
|---|---|---|---|
| 1,240,859 | 9/1917 | Lallman | 102/470 |
| 2,419,949 | 5/1947 | Hottinger | 102/469 |
| 2,446,187 | 8/1948 | Meister | 102/202 |
| 2,789,043 | 4/1957 | Maxwell et al. | 102/205 X |
| 2,853,007 | 9/1958 | Verga Casati | 102/204 |
| 3,224,373 | 12/1965 | Kramer | 102/202 |
| 3,332,353 | 7/1967 | Burkardt et al. | 102/202 |
| 3,393,639 | 7/1968 | Bolieau et al. | 102/202 |
| 3,581,662 | 6/1971 | Grebert | 102/202 |
| 3,906,720 | 9/1975 | Boydston | 102/202 X |
| 4,029,015 | 6/1977 | Lachaussee et al. | 102/204 X |

FOREIGN PATENT DOCUMENTS

| | | | |
|---|---|---|---|
| 484990 | 7/1952 | Canada | 102/469 |
| 2553717 | 6/1976 | Fed. Rep. of Germany | 102/470 |
| 2343987 | 10/1977 | France | 102/470 |

*Primary Examiner*—Charles T. Jordan
*Assistant Examiner*—John E. Griffiths, Jr.
*Attorney, Agent, or Firm*—Antonelli, Terry & Wands

[57] ABSTRACT

A flash guide tube arrangement utilized primarily in propellant charge igniters for large-caliber ammunition with laterally located openings from which the ignition gases, emitted by conventional ignition systems, exit, either for the ignition of an ignition booster charge or for the direct ignition of a propellant charge. Indentations emanate axially from these openings and extend into the interior of the flash guide tube, the depth of the individual indentations decreasing in the direction toward the rear end of the flash guide tube. The indentations are preferably radially arranged and several of such radially disposed indentations can be provided in the flash guide tube. The rear end of the flash guide tube can furthermore be constructed as a cone having its apex pointing toward the ignition system.

9 Claims, 3 Drawing Figures

FLASH GUIDE TUBE ARRANGEMENT FOR PROPELLANT CHARGE IGNITERS

The present invention relates to a flash guide tube arrangement in propellant charge igniters, which flash guide tube is primarily utilized for the ignition of large amounts of powder, as existing, for example, in large-caliber ammunition. Such propellant charge igniters contain a conventional ignition system made up of a mechanical or electrical primer cap and a primer charge, both of these components being arranged at one end of a flash guide tube. An ignition booster charge, for example in the form of an annular column of tablets, is preferably provided around the flash guide tube. The ignition booster charge is arranged within an ignition-transmitting housing laterally equipped with openings for the exiting of the ignition gases of the ignition booster charge.

In these conventional propellant charge igniters, the combustion gases of the primer charge, which latter is optionally disposed in a pressure chamber, flow, after ignition of the primer charge, into the flash guide tube, the latter being laterally equipped with radial openings for the exiting of the ignition flame. By means of the gases flowing out of these openings, either an ignition booster charged or a propellent charge directly can be ignited.

This conventional arrangement has the disadvantage that the propellant charge or the booster charge is ignited eariler in the zone closer to the primer charge than in the regions farther remote therefrom, so that there is no uniform distribution of the flame front of the ignited charge over its axial extension. Such a locally and temporally differing distribution of the ignition flame front, however, is undesirable. Furthermore, in this conventional arrangement, considerable reflections of the axial pressure or shock wave emanating from the primer charge occur within the flash guide tube, which can lead to standing pressure wave. Due to such standing pressure waves, the locally and temporally nonuniform ignition of, for example, an ignition booster charge is still further intensified.

It is therefore an object of the present invention to overcome the disadvantages of the conventional propellant charge igniters and provide a propellant charge igniter wherein the flash guide tube enables at least a temporary maximum uniform ignition of an ignition booster charge along the entire length thereof so that the ignition booster charge produces after its ignition a uniform flame front.

In accordance with the present invention, the flash guide tube for propellant charge igniters for ammunition comprises an elongated tube provided with lateral openings for the exiting of ignition gases and axially arranged indentations or crimped portions of the flash guide tube emanating from the openings and projecting into the interior of the flash guide tube, the individual indentations having a depth which decreases in the direction toward the rear end of the flash guide tube.

The flash guide tube of the present invention is especially suitable for propellant charge igniters used for the purpose of igniting large-caliber ammunition. Such propellant charge igniters exhibit an ignition-conducting housing provided with radial or circumferential outlet openings. An ignition booster charge is arranged within the housing and extends radially about the flash guide tube which is located coaxially in the interior.

The indentations, respectively starting at the openings of the flash guide tube, extend into the flash guide tube as elongate portions. They become shallower toward the rear end of the flash guide tube, the rear end of the flash guide tube being understood to mean the end facing away from the ignition system. The axial length of these indentations depends, inter alia, on the diameter of the flash guide tube, the size of the lateral openings in the flash guide tube, and the flow velocity of the flame gases of the booster charge. In general, the length of the indentations is about half as large to twice as large as the diameter of the flash guide tube. The indentation, at its end, i.e. on the side facing away from the ignition system, passes over into the wall of the flash guide tube.

The indentations can have the shape of a conical section. However, they can also be in the form of tangs and can be severed from the wall of the flash guide tube at their start, i.e. the lowest point in the zone of the lateral openings, so that they extend at that location in the form of tongues into the flash guide tube. The angle formed between the indentations or tangs and the wall of the flash guide tube is smallest in case of those indentations lying closest to the ignition system, so that at that point the indentations or tangs project only slightly into the interior of the flash guide tube. Toward the rear end of the flash guide tube, this angle, in a preferred embodiment, becomes increasingly larger so that at the rear end of the flash guide tube the indentations, with constant length, project farthest into the interior of the flash guide tube.

The lateral openings of the flash guide tube with the adjoining indentations are preferably radially or circumferentially arranged. In such a case, the openings lie in a cross-sectional plane of the flash guide tube. In such a plane, two or more openings are thus annularly disposed uniformly over the circumference of the flash guide tube.

According to the present invention, it is sufficient if a single such ring of openings with the adjoining indentations is provided. However, it is expedient to arrange two or more of such rings of openings in the flash guide tube; in this connection, with each ring of openings, the associated indentations are to project into the tube with identical depths. The indentations at the last ring of openings before the rear end of the flash guide tube can then also extend into the interior of the flash guide tube to such a degree that they fully cover the tube cross section. If, at this location, three or more radial or circumferentially lateral openings at the flash guide tube constitute a ring of openings, the indentations form an irregular, truncated cone in the interior of the flash guide tube with the pointed end of the cone being oriented toward the ignition system.

The depth at which the indentations project into the flash guide tube is primarily dependent on the flow velocity and the composition of the ignition gases. This depth also depends on the fact whether only one, or two or more rings of openings are arranged over the length of the flash guide tube.

It is furthermore recommended in accordance with this present invention to fashion the rear end of the flash guide tube to be of a conical shape with the apex of the cone pointing toward the ignition system. The angle of the cone is again dependent primarily on the flow velocity and sonic speed of the hot ignition gases. This cone has the task of eliminating, by interference, the reflections of the oncoming pressure front of the ignition gases.

These and other objects, features and advantages of the present invention will become more apparent from the following description when taken in connection with the accompanying drawings, which show, for purposes of illustration only, several embodiments in accordance with the present invention.

BRIEF DESCRIPTION OF THE DRAWINGS

Referring now to the drawings, FIG. 1 illustrates a longitudinal section through a propellant charge igniter with a flash guide tube 1 according to the present invention. The igniter includes an ignition-conducting housing 4 having a primer charge 5 disposed at one end and arranged for connection with the flash guide tube 1. A booster charge 6 is arranged between the flash guide tube 1 and the wall of the ignition-conducting housing 4 so as to surround the flash guide tube. The wall of the ignition-conducting housing 4 contains openings (not illustrated) in the zone of the booster charge 6 so as to enable ignition of a surrounding propellant charge.

The flash guide tube 1 is provided with openings 2 radially or circumferentially arranged on a cross-sectional area of the flash guide tube in a plane transverse to the longitudinal axis of the flash guide tubes. FIG. 1 shows respectively one pair of such openings 2 in a cross-sectional area of one plane, as more clearly illustrated in FIG. 2. However, it is also possible to provide more than two openings in a cross-sectional area of such a plane.

Indentations or crimped portions of the flash guide tube adjoin the openings 2 and extend into the flash guide tube 1 as can be seen from FIG. 1 as well as FIGS. 2 and 3, which illustrate a section through the flash guide tube in the region of the indentations. FIGS. 2 and 3 show two possible embodiments for the geometrical configuration of the indentations with the only important factor being that the indentations project into the interior of the flash guide tube and are fashioned so that the depth of the individual indentations decreases in the direction toward the rear end of the flash guide tube 1. As shown in FIG. 1, the rear end of the flash guide tube 1 is fashioned as a cone 3 with the apex thereof extending in the direction of the ignition system of primer charge 5. Further as shown, the angle at which the indentations project into the interior of the flash guide tube increases in the direction toward the rear end of the flash guide tube.

Figure 1:
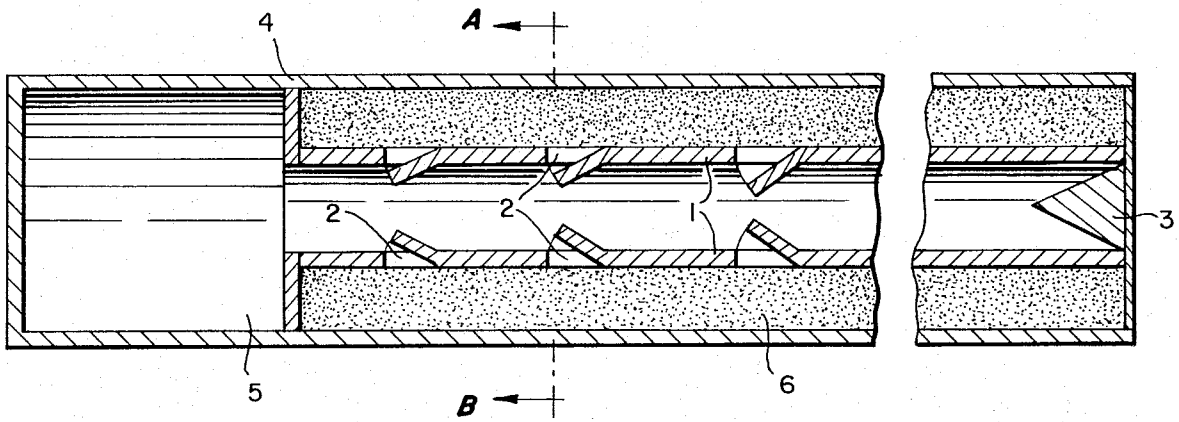
FIG. 1 is a longitudinal sectional view of propellent charge igniter with a flash guide tube in accordance with the present invention.
Figure 2:
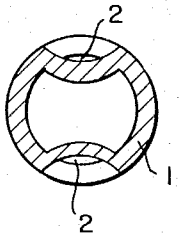
FIG. 2 is a cross sectional view of the flash guide tube along the plane A-B of FIG. 1.
Figure 3:
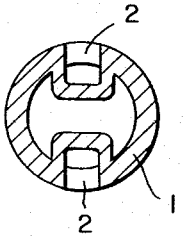
FIG. 3 is a cross sectional view of another flash guide tube embodiment of the present invention.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

We claim:

1. A flash guide tube arrangement for propellant charge igniters for ammunition comprising an elongated tube having front and rear ends and lateral openings for the exiting of ignition gases, and axially arranged indentation means of the flash guide tube emanating from and adjoining the openings, the indentation means projecting inwardly toward the interior of the flash guide tube with the individual indentation means having a depth which decreases in the direction toward the rear end of the flash guide tube.

2. A flash guide tube arrangement according to claim 1, wherein the openings with the adjoining indentation means are circumferentially spaced from one another.

3. A flash guide tube arrangement according to claim 1, wherein the openings with the adjoining indentation means includes at least two openings with adjoining indentation means arranged in a cross-sectional plane extending transversely to the longitudinal axis of the tube and uniformly distributed over the circumference of the tube in the form of at least one ring of openings.

4. A flash guide tube arrangement according to claim 3, wherein at least two rings of openings are axially spaced from each other over the length of tube.

5. A flash guide tube arrangement according to claim 1 or claim 4, wherein the indentation means project inwardly at an angle with respect to the tube wall which increases in the direction toward the rear end of the tube.

6. A flash guide tube arrangement according to one of claims 1, 2, 3, or 4, wherein the rear end of the tube is closed by a cone shaped member having the apex thereof pointing toward the front end of the tube.

7. A flash guide tube arrangement according to claim 5, wherein the rear end of the tube is closed by a cone shaped member having the apex thereof pointing toward the front end of the tube.

8. A flash guide tube arrangement according to claim 7, further comprising means coupled to the front end of the flash guide tube for propagating an ignition flame toward the rear end of the tube, charge means at least partially surrounding the flash guide tube, the indentation means adjoining the openings enabling a uniform ignition of the charge means.

9. A flash guide tube arrangment according to claim 8, further comprising an ignition housing surrounding the flash guide tube, the charge means including a booster charge disposed between the flash guide tube and the ignition housing.

* * * * *